US007069217B2

(12) United States Patent
McLaughlin et al.

(10) Patent No.: US 7,069,217 B2
(45) Date of Patent: Jun. 27, 2006

(54) WAVEFORM SYNTHESIS

(75) Inventors: Stephen McLaughlin, Edinburgh (GB); Michael Banbrook, Cambridge (GB)

(73) Assignee: British Telecommunications PLC, London (GB)

( * ) Notice: Subject to any disclaimer, the term of this patent is extended or adjusted under 35 U.S.C. 154(b) by 0 days.

(21) Appl. No.: 09/043,171

(22) PCT Filed: Jan. 9, 1997

(86) PCT No.: PCT/GB97/00060

§ 371 (c)(1),
(2), (4) Date: Mar. 12, 1998

(87) PCT Pub. No.: WO97/26648

PCT Pub. Date: Jul. 24, 1997

(65) Prior Publication Data

US 2001/0018652 A1 Aug. 30, 2001

(30) Foreign Application Priority Data

Jan. 15, 1996 (GB) ..... 9600774.5

(51) Int. Cl.
*G10L 13/06* (2006.01)

(52) U.S. Cl. ..... 704/269; 704/266

(58) Field of Classification Search ..... 704/276, 704/205, 206, 270, 271, 258, 259, 260, 261, 704/264, 265, 266, 268, 267, 269, 262, 263
See application file for complete search history.

(56) References Cited

U.S. PATENT DOCUMENTS 4,022,974 A 5/1977 Kohut et al.
4,622,877 A 11/1986 Strong
4,635,520 A * 1/1987 Mitsumi ..... 84/607
4,718,093 A * 1/1988 Brown ..... 704/243
5,111,505 A * 5/1992 Kitoh et al. ..... 704/265
5,745,651 A * 4/1998 Otsuka et al. ..... 704/266
5,832,437 A * 11/1998 Nishiguchi et al. ..... 704/268

FOREIGN PATENT DOCUMENTS

EP 385 444 9/1990

OTHER PUBLICATIONS

Gabriel B. Mindlin et al. (Topological analysis and sunthesis of chaotic time series) , Physica D, pp. 229-242, 1992.*

(Continued)

*Primary Examiner*—Abul K. Azad
(74) *Attorney, Agent, or Firm*—Nixon & Vanderhye P.C.

(57) ABSTRACT

A synthesizer is disclosed in which a speech waveform is synthesized by selecting a synthetic starting waveform segment and then generating a sequence of further segments. The further waveform segments are generated based jointly upon the value of the immediately-preceding segment and upon a model of the dynamics of an actual sound similar to that being generated. In particular, a method is disclosed of a voiced speech sound comprising calculating each new output value from the previous output value using data modeling the evolution, over a short time interval, of the voiced speech sound to be synthesized. This sequential generation of waveform segments enables a synthesized sequence of speech waveforms to be generated of any duration. In addition, a low-dimensional state space representation of speech signals are used in which successive pitch pulse cycles are superimposed to estimate the progression of the cyclic speech signal within each cycle.

16 Claims, 13 Drawing Sheets

OTHER PUBLICATIONS

Daniel P. Lathrop et al. (Characterization of an experimental strange attractor by periodic orbits), Physical Review, p. 4028-4031, 1989.*

Mark Shelhamer (Correlation Dimension of Optokinetic Nystragmus as Evidence of Chaos in the Oculomotor System), IEEE Transactions on Biomedical Engineering, vol. 39, No. 12, p. 1319-1321, 1992.*

IEEE 100 The Authoritative Dictionary of IEEE Standards Terms, Seventh Edition, Standards Information Network IEEE Press 2000. p. 1000.*

IEICE Transactions on Fundamentals of Electronics, Communications and Computer Sciences, vol. E76-A, No. 11, Nov. 1993, JP, pp. 1964-1970, Hirokawa et al, "High quality speech synthesis system based on waveform concatenation of phoneme segment".

International Conference on Acoustics, Speech, and Signal Processing 1988, vol. 1, Apr. 11-14, 1988, New York, NY, pp. 675-678, Everett, "Word synthesis based on line spectrum pairs".

IBM Technical Disclosure Bulletin, vol. 28, No. 3, Aug. 1985, New York, US, pp. 1248-1249, Anonymous, Use of the Grid Search Technique for Improving Synthetic Speech Control-Data.

IEE Colloquium on 'Exploiting Chaos in Signal Processing' (Digest No. 1994/143), Jun. 6, 1994, London, GB, pp. 8/1-10, Banbrook et al, "Is speech chaotic?: invariant geometrical measures for speech data".

M. Casdagli, "Chaos and Deterministic versus Stochastic Non-Linear Modelling", Journal of the Royal Statistical Society B, vol. 54, No. 2, pp. 303-328, 1991.

M. Banbrook and S. McLaughlin, "Speech Characterisation by Non-Linear Methods", presented at IEEE workshop on Nonlinear Signal and Image Processing NSIP '95, pp. 396-400, Jun. 1995.

Kleijn, W.B. and Paliwal, K.K. (Eds), 'Speech Coding and Synthesis', pp. 557-559, 581-587, 600-610 Elsevier Science B.V., 1995.

Westall, F.A. and Ip, S.F.A, "Digital Signal Processing in Telecommunications", pp. 295-297, Chapman & Hall, 1993.

* cited by examiner

CPU
6
DAC
4
2
PROGRAM
8b
RAM
8a
8
8c
X1
X2
X3
X4
X5
XN
T1
T2
T3
T4
T5
TN
11c
12c
10c
11b
12b
10b
12a
10a
11a

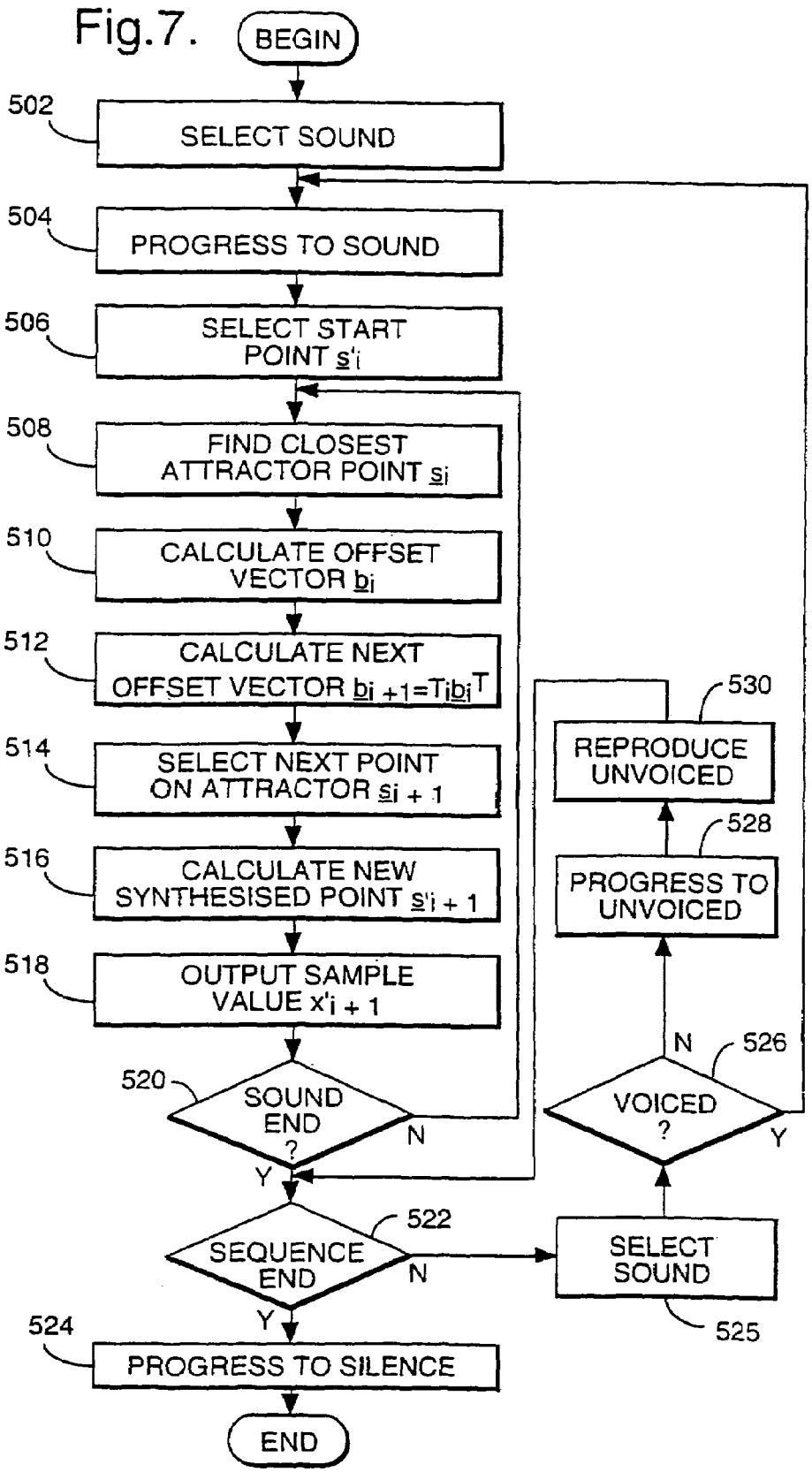
Fig.7.
BEGIN
502
SELECT SOUND
504
PROGRESS TO SOUND
506
SELECT START POINT s'i
508
FIND CLOSEST ATTRACTOR POINT si
510
CALCULATE OFFSET VECTOR bi
512
CALCULATE NEXT OFFSET VECTOR bi+1=Tibi^T
514
SELECT NEXT POINT ON ATTRACTOR si+1
516
CALCULATE NEW SYNTHESISED POINT s'i+1
518
OUTPUT SAMPLE VALUE x'i+1
520
SOUND END ?
N
Y
522
SEQUENCE END
N
Y
524
PROGRESS TO SILENCE
END
SELECT SOUND
525
526
VOICED ?
N
Y
528
PROGRESS TO UNVOICED
530
REPRODUCE UNVOICED

WAVEFORM SYNTHESIS

I. FIELD OF INVENTION

This invention relates to methods and apparatus for waveform synthesis, and particularly but not exclusively for speech synthesis.

II. BACKGROUND AND SUMMARY OF INVENTION

Various types of speech synthesizers are known. Most operate using a repertoire of phonemes or allophones, which are generated in sequence to synthesise corresponding utterances. A review of some types of speech synthesizers may be found in A. Breen "Speech Synthesis Models: A Review", Electronics and Communication Engineering Journal, pages 19–31, February 1992. Some types of speech synthesizers attempt to model the production of speech by using a source-filter approximation utilising, for example, linear prediction. Others record stored segments of actual speech, which are output in sequence.

A major difficulty with synthesised speech is to make the speech sound natural. There are many reasons why synthesised speech may sound unnatural. However, a particular problem with the latter class of speech synthesizers, utilising recorded actual speech, is that the same recording of each vowel or allophone is used on each occasion where the vowel or allophone in question is required. This becomes even more noticeable in those synthesizers where, to generate a sustained sound, a short segment of the phoneme or allophone is repeated several times in sequence.

The present invention, in one aspect, provides a speech synthesizer in which a speech waveform is directly synthesised by selecting a synthetic starting value and then selecting and outputting a sequence of further values, the selection of each further value being based jointly upon the value which preceded it and upon a model of the dynamics of actual recorded human speech.

Thus, a synthesised sequence of any required duration can be generated. Furthermore, since the progression of the sequence depends upon its starting value, different sequences corresponding to the same phoneme or allophone can be generated by selecting different starting values.

The present inventors have previously reported ("Speech characterisation by non-linear methods", M. Banbrook and S. McLaughlin, submitted to IEEE Transactions on Speech and Audio Processing, 1996; "Speech characterisation by non-linear methods", M. Banbrook and S. McLaughlin, presented at IEEE Workshop on non-linear signal and image processing, pages 396–400, 1995) that voiced speech, with which the present invention is primarily concerned, appears to behave as a low dimensional, non-linear, non-chaotic system. Voiced speech is essentially cyclical, comprising a time series of pitch pulses of similar, but not identical, shape. Therefore, in a preferred embodiment, the present invention utilises a low dimensional state space representation of the speech signal, in which successive pitch pulse cycles are superposed, to estimate the progression of the speech signal within each cycle and from cycle-to-cycle.

This estimate of the dynamics of the speech signal is useful in enabling the synthesis of a waveform which does not correspond to the recorded speech on which the analysis of the dynamics was based, but which consists of cycles of a similar shape and exhibiting a similar variability to those on which the analysis was based.

For example, the state space representation may be based on Takens' Method of Delays (F. Takens, "Dynamical Systems and Turbulence", Vol. 898 of Lecture Notes in Mathematics, pages 366–381. Berlin: Springe 1981). In this method, the different axes of the state space consist of waveform values separated by predetermined time intervals, so that a point in state space is defined by a set of values at $t_1$, $t_2$, $t_3$ (where $t_2-t_1=\Delta_1$ and $t_3-t_2=\Delta_2$, which are both constants and may be equal).

Another current problem with synthesised speech is that where different sounds are concatenated together into a sequence, the "join" is sometimes audible, giving rise to audible artifacts such as a faint modulation at the phoneme rate in the synthesised speech.

Accordingly, in another aspect the present invention provides a method and apparatus for synthesising speech in which an interpolation is performed between state space representations of the two speech sounds to be concatenated, or, in general, between correspondingly aligned portions of each pitch period of the two sounds. Thus, one pitch pulse shape is gradually transformed into another.

BRIEF DESCRIPTION OF THE DRAWINGS

Other aspects and preferred embodiments of the invention will be apparent from the following description and claims.

The invention will now be illustrated, by way of example only, with reference to the accompanying drawings in which:—

FIG. 7 is a flow diagram showing illustratively the method of operation of the speech synthesizer of FIG. 6;

DETAILED DESCRIPTION OF A PREFERRED EMBODIMENT OF THE INVENTION

State Space Representation of the Speech Signal

Before describing embodiments of the invention in detail, a brief description will be given of the state space representation of the speech signal utilised in embodiments of the invention (but known in itself as a tool for analysis of speech, for example from "Lyapunov exponents from a time series: a noise-robust extraction algorithm"; M. Banbrook, G. Ushaw, S. McLaughlin, submitted to IEEE Transactions on signal processing, October 1995 to which reference is made if further detail is required).

Figure 1:
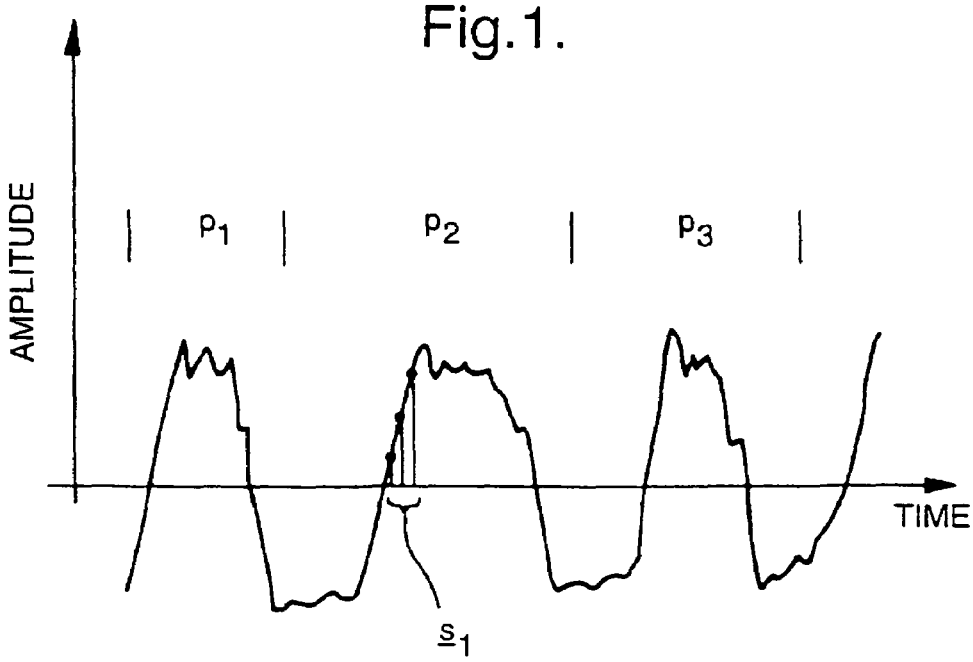
FIG. 1 is a diagram of signal amplitude against time for a (notional) voiced speech signal.

FIG. 1 illustrates a speech signal or, more accurately, a portion of a voiced sound comprised within a speech signal. The signal of FIG. 1 may be seen to consist of a sequence of similar, but not identical, pitch pulses $p_1$, $p_2$, $p_3$. The shape of the pitch pulses characterises the timbre of the voiced sound, and their period characterises the pitch perceived.

Figure 2:
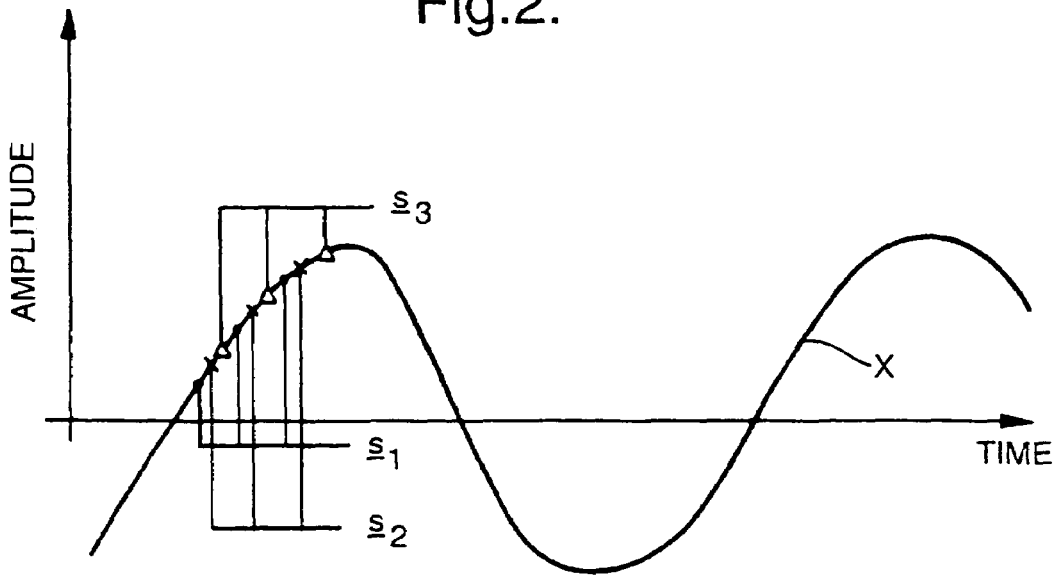
FIG. 2 is a diagram of signal amplitude against time for a notional cyclical waveform, illustrating the derivation of state sequence points based on the method of delays.

Referring to FIG. 2, to produce a state space representation of a time sequence X, a plurality (in this case 3) of values of the waveform X at spaced apart times, $x_{i-10}$, $x_i$, $x_{i+10}$ are taken and combined to represent a single point $\underline{s}_i$ in a space defined by a corresponding number of axes.

Figure 3:
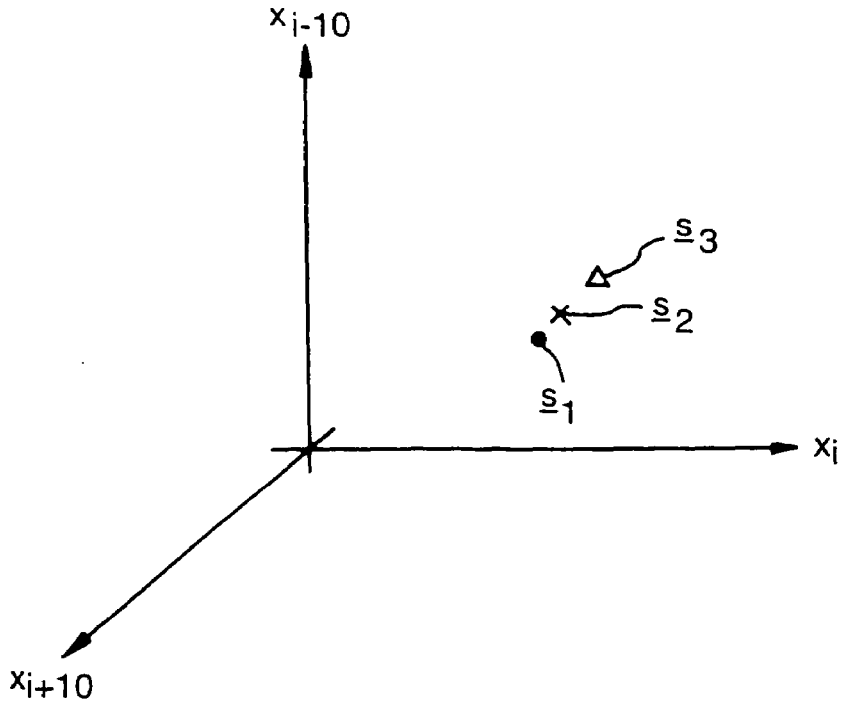
FIG. 3 is a state sequence space plot of the points of FIG. 2.

Thus, referring to FIGS. 2 and 3, a first point $\underline{s}_1$ is represented by the three dots on the curve X representing values of the waveform X at sample times 0, 10, 20 ($x_0$, $x_{10}$ and $x_{20}$ respectively). Since all three of these values are positive, the point they define $\underline{s}_i$ lies in the positive octant of the space of FIG. 3.

A further point $\underline{s}_2$ is represented by the three crosses in FIG. 2 on the waveform X. This point is defined by the three values $x_1$, $x_{11}$ and $x_{21}$. Since all three of these values are more positive than those of the point $\underline{s}_1$, the point $\underline{s}_2$ in the state sequence space of FIG. 3 will lie in the same octant and radially further out than the point s.

Likewise, a third point $\underline{s}_3$ is defined by values of the waveform X at times 2, 12 and 22 ($x_2$, $x_{12}$ and $x_{22}$ respectively). This point is indicated by three triangles on the waveform X in FIG. 2.

Thus, in general, in this time delay method of constructing a state space representation of the time sequence X (i.e. speech waveform), for each successive time sample $x_i$, the corresponding point $\underline{s}_i$ in the state sequence space is represented by the value of that point $\underline{s}_i$ together with those of a preceding and a succeeding point $x_{i+j}$, $x_{i+k}$ (where j is conveniently equal to k and in this case both are equal to 10).

If the waveform of FIG. 2 were simply a diagonal straight line, its representation in the state space of FIG. 3 would likewise be a straight line.

However, for a repetitive time sequence of the type shown in FIG. 1 or 2, points of inflection in the waveform cause the corresponding sequence of points in state space to define a trajectory which likewise inflects, and follows a substantially closed loop to return close to its start point. Since the relative values of the points $x_i$, $x_{i-j}$, $x_{i+k}$, are closely similar for successive cycles of the time sequence they represent, referring to FIG. 4, the state space representation of a sequence of N cycles (e.g. pitch pulses $p_1$–$p_n$) of a waveform will be a continuous trajectory through the state sequence space performing N closely similar circuits, so as to define a circuitous multidimensional surface, or manifold, containing N strands or tracks. The surface which would be generated by an infinite number of such cycles is referred to as the "attractor" of the waveform X giving rise to it.

Figure 4:
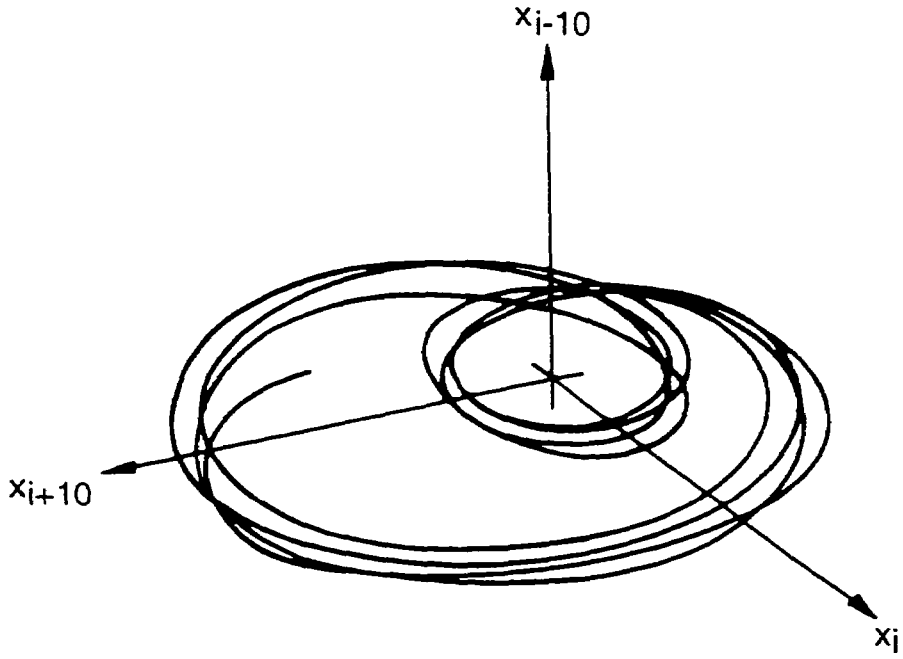
FIG. 4 is a state sequence space plot showing the trajectory of a notional voiced speech sound defining an attractor in the state sequence space.

The attractor of FIG. 4 consists of a double loop (which, in the projection indicated, appears to cross itself but does not in fact do so in three dimensions).

Figure 5:
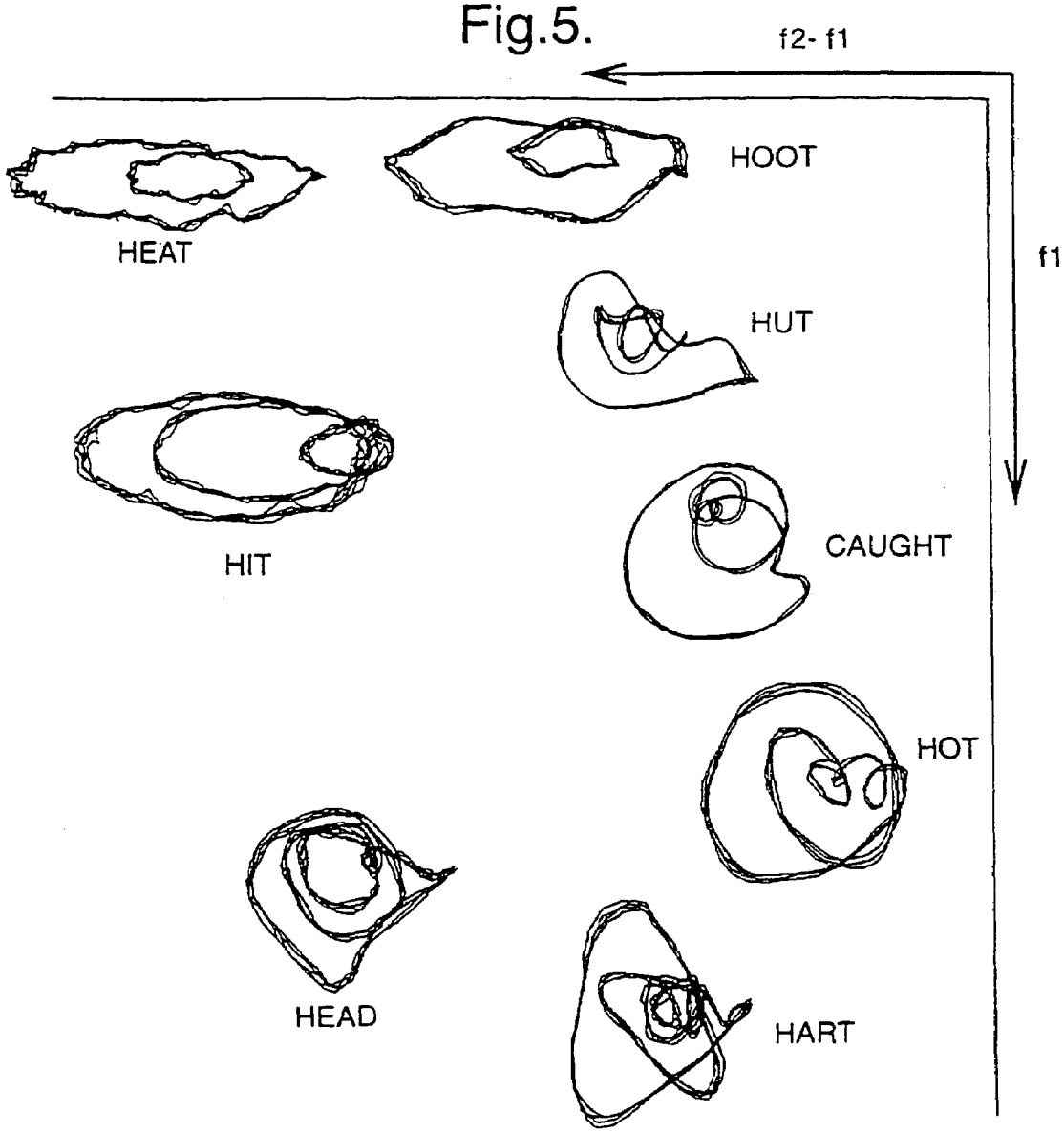
FIG. 5 is an illustrative diagram, on a formant chart showing state sequence space attractors (corresponding to that of FIG. 4) for a plurality of different vowels.

Referring to FIG. 5, we have determined that each voiced sound gives rise to an attractor of this nature, all of which can adequately be represented in a three dimensional state space, although it might also be possible to use as few as two dimensions or as many as four, five or more. The important parameters for an effective representation of voiced sounds in such a state space are the number of dimensions selected and the time delay between adjacent samples.

As shown in FIG. 5 in which the axes over which the attractors are distributed are $f_1$ (the frequency of the first formant) against $f_2$–$f_1$ (where $f_2$ is the frequency of the second formant), the shapes of the attractors vary considerably (with the corresponding shapes of the speech waveforms to which they correspond) although there is some relationship between the topologies of respective attractors and the sounds to which they correspond.

The discussion above relates to voiced sounds (such as vowels and voiced consonants). It is, of course, possible to provide a state sequence representation of any waveform, but in the case of unvoiced sounds (e.g. fricatives) the state space representation will not follow successive closely similar loops with a well defined topology, but instead will follow a trajectory which passes in an apparently random fashion through a volume in the state sequence space.

Overview of First Embodiment of the Invention

Figure 6:
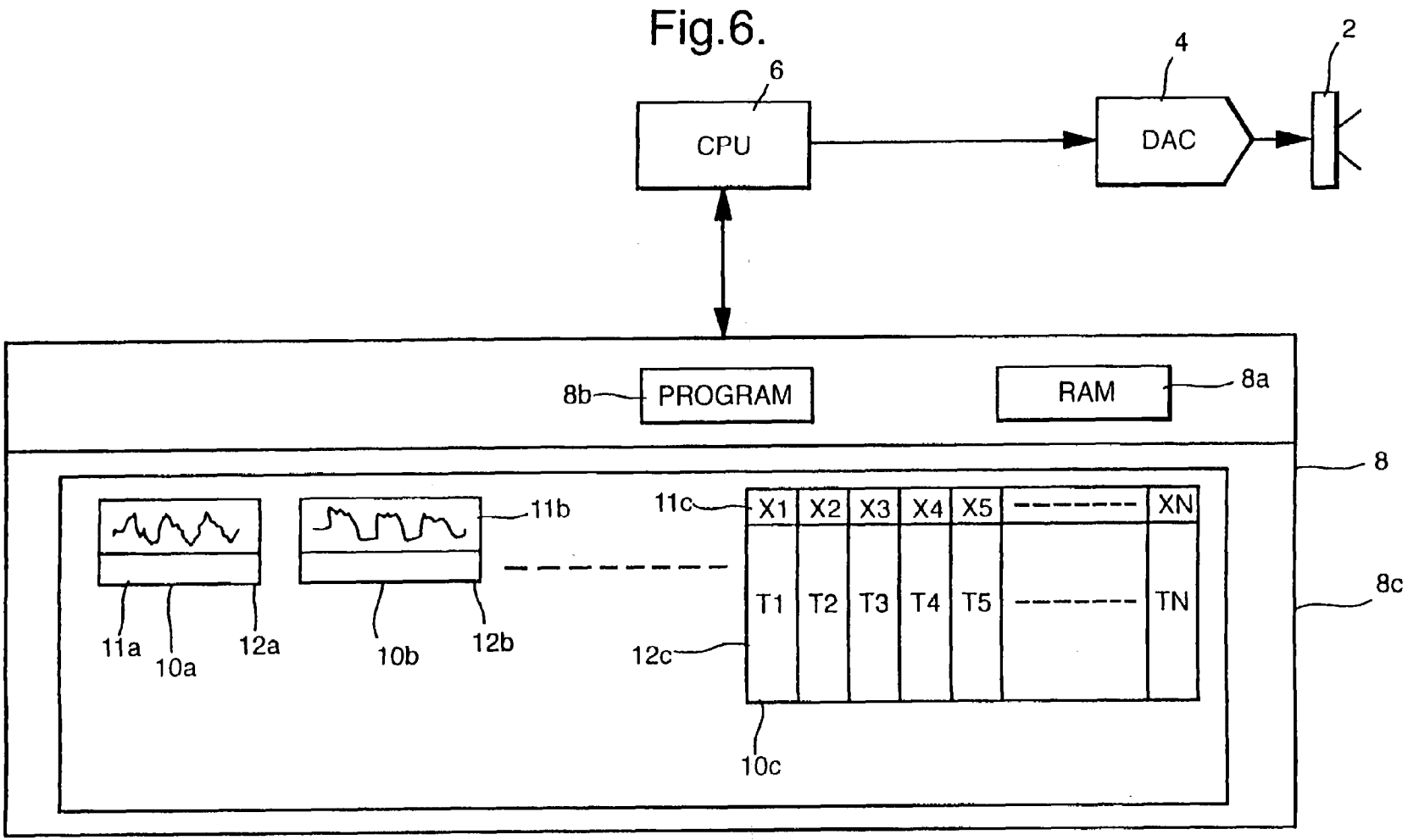
FIG. 6 is a block diagram showing schematically the structure of a speech synthesizer according to a first embodiment of the invention.

Referring to FIG. 6, in a first embodiment of the invention a speech synthesizer comprises a loudspeaker 2, fed from the analogue output of a digital to analog converter 4, coupled to an output port of a central processing unit 6 in communication with a storage system 8 (comprising random access memory 8*a*, for use by the CPU 6 in calculation; program memory 8*b* for storing the CPU operating program; and data constant memory 8*c* for storing data for use in synthesis).

The apparatus of FIG. 6 may conveniently be provided by a personal computer and sound card such as an Elonex (TM) Personal Computer comprising a 33 MHz Intel 486 microprocessor as the CPU 6 and an Ultrasound Max. (TM) soundcard providing the digital to analogue converter 4 and output to a loudspeaker 2. Any other digital processor of similar or higher power could be used instead.

Conveniently, the storage system 8 comprises a mass storage device (e.g. a hard disk) containing the operating program and data to be used in synthesis and a random access memory comprising partitioned areas 8*a*, 8*b*, 8*c*, the program and data being loaded into the latter two areas, respectively, prior to use of the apparatus of FIG. 6.

The stored data held within the stored data memory 8*c* comprises a set of records 10*a*, 10*b*, . . . 10*c*, each of which represents a small segment of a word which may be considered to be unambiguously distinguishable regardless of its context in a word or phrase (i.e. each corresponds to a phoneme or allophone). The phonemes can be represented by any of a number of different phonetic alphabets; in this embodiment, the SAMPA (Speech Assessment Methodology Phonetic Alphabet, as disclosed in A. Breen, "Speech Synthesis Models: A Review", Electronics and Communication Engineering Journal, pages 19–31, February 1992) is used. Each of the records comprises a respective waveform recording 11, comprising successive digital values (e.g. sampled at 20 kHz) of the waveform of an actual utterance of the phoneme in question as successive samples $x_1$, $x_2 \ldots x_N$.

Additionally, each of the records 10 associated with a voiced sound (i.e. the vowels and voiced consonant sounds of the phonetic alphabet) comprises, for each stored sample $x_i$, a transform matrix defined by nine stored constant values.

Thus, the data memory 8*c* comprises on the order of thirty to forty records 10 (depending the phonetic alphabet chosen), each consisting of the order of half a second of recorded digital waveforms (i.e., for sampling at 20 kHz, around ten thousand samples $x_i$, each of the sample records for voiced sounds having an associated nine element transform matrix). The volume required by the data memory 8*c* is thus ((9+1)×10,000×40=400,000) 16 bit memory locations.

The manner in which the contents of the data memory 8*c* are derived will be described in greater detail below.

Figure 8:
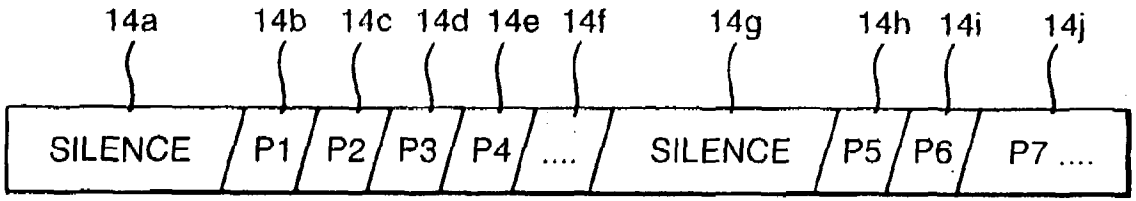
FIG. 8 is a time line showing illustratively the sequence of speech and silence segments making up a speech utterance.

As indicated in FIG. 8, an utterance to be synthesised by the speech synthesizer consists of a sequence of portions each with an associated duration, comprising a silence portion 14*a* followed by a word comprising a sequence of portions 14*b*–14*f* each consisting of a phoneme of predetermined duration, followed by a further silence portion 14*g*, followed by a further word comprised of phoneme portions 14*h*–14*j* each of an associated duration, and so on. The sequence of phonemes, together with their durations, are either stored or derived by one of several well known rule systems forming no part of the present invention, but comprised within the control program.

Referring to FIG. 7, the operation of the control program of the CPU 6 will now be described in greater detail.

In accordance with a sequence thus determined, in a step 502, the CPU 6 selects a first sound record 10 corresponding to one of the phonemes of the sequence illustrated in FIG. 8.

In a step 504, the CPU 6 executes a transition to the sound as will be described in greater detail below.

In a step 506, the CPU 6 selects a start point for synthesis of the phoneme waveform, $x'_i$. Referring to FIG. 9, the selection of the start point for synthesis consists of two stages. Firstly, as a result of the progression step 504, as discussed in greater detail below, the CPU 6 will have selected some point $x_i$ on the stored waveform. The next step is then to select a new point, randomly located within a region close to the already selected point in the state sequence space.

Figure 9D:
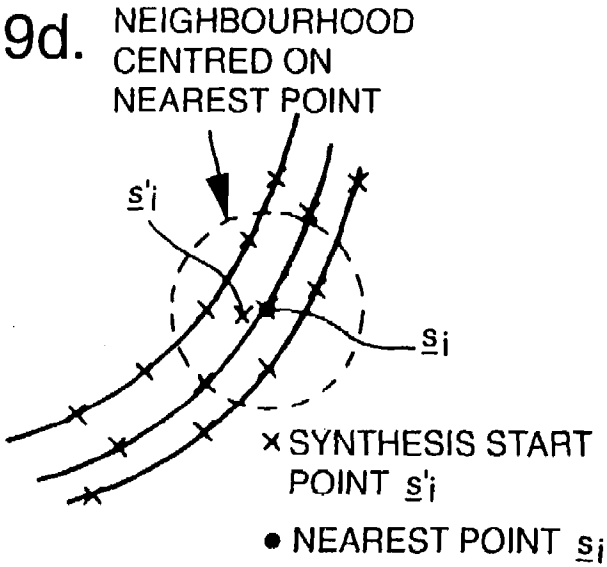
FIG. 9*d* is a detail thereof showing the neighbourhood surrounding a point on one cycle, the transformation of which over time is utilised in the embodiment of FIG. 6.
Figure 9C:
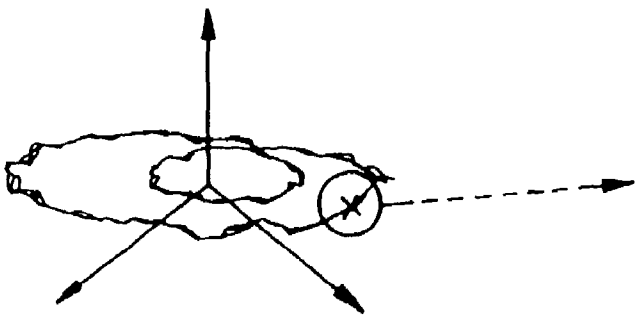
FIG. 9*c* is a state sequence space diagram showing multiple cycles of a waveform.
Figure 9A:
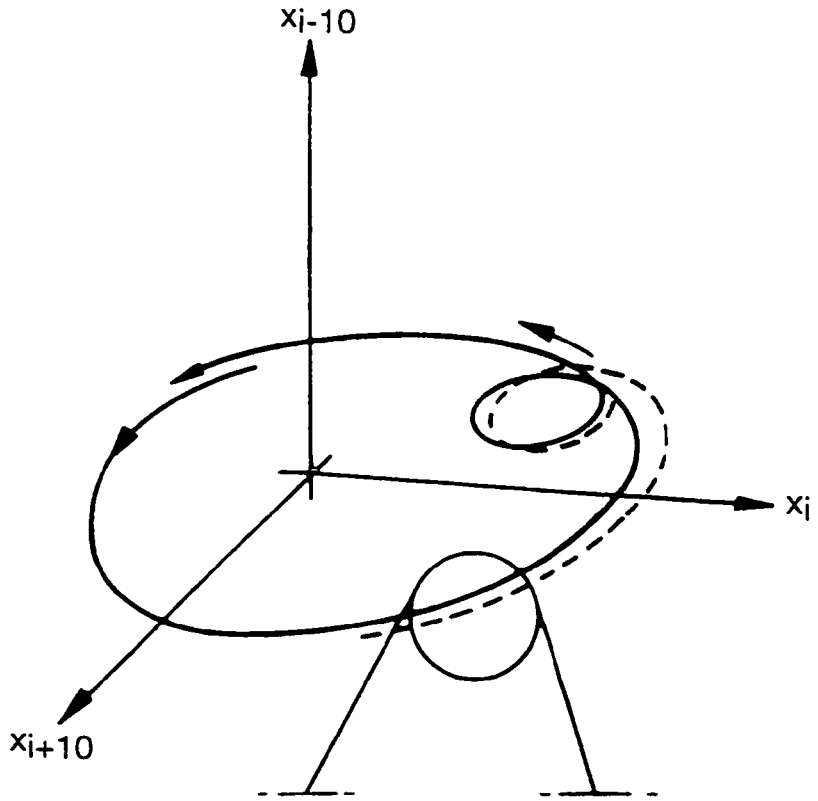
FIG. 9*a* is a state sequence space plot showing a single cycle of a notional voiced sound, and a portion of a cycle of a synthesised sound synthesised therefrom.
Figure 9B:
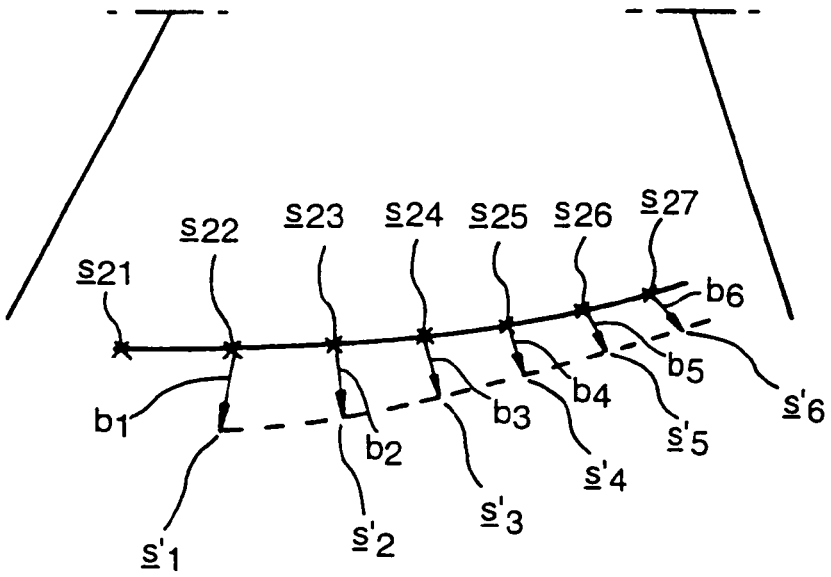
FIG. 9*b* is a detail of FIG. 9*a;*

For example, referring to FIG. 9*b*, the most recent stored point accessed by the CPU 6 (and output to the DAC 4 and hence the loudspeaker 2 as synthesised sound) is point $x_{21}$ with corresponding state space point $\underline{s}_{21}$, and in step 506, a first synthesised start point $\underline{s}'_i$ is selected close to $\underline{s}_{21}$.

The mechanism for selecting a close point may be as follows:

1. The first point $\underline{s}_i$ in state sequence space is found by reading values $x_i$, $x_{i+10}$ and $x_{i+10}$.
2. The next point $\underline{s}_{i+1}$ on the trajectory in state sequence space is found by accessing values $x_{i+1}$, $x_{i+11}$, and $x_{i+s}$.
3. The euclidean (i.e. root mean square) distance in the state sequence space between the two points $\underline{s}_i$, $\underline{s}_{i+1}$ is calculated.
4. A pseudo random sequence algorithm is used to generate the random coordinates of a point $\underline{s}'_i$ in state space, spaced from the point $\underline{s}_i$ by a euclidean distance between zero and the distance thus calculated.

Having thus determined a first synthesised start point $\underline{s}'_1$ close to, but not coincident with, one strand of the state space trajectory marked out by the stored sample values, in the region of the last actual point output ($x_{21}$ in this case), in step 508, the CPU 6 determines the closest point on the stored trajectory to the newly synthesised point $\underline{s}'_1$.

Very often the closest point selected in step 508 will in fact be the last point on the current strand (in this case $\underline{s}_{21}$). However, it may correspond instead to one of the nearest neighbours on that strand (as in this case, where $\underline{s}_{22}$ is closer), or to a point on another strand of the trajectory where this is closely spaced in the state sequence space, as indicated in FIG. 9*c*.

Having thus determined the closest point on the stored trajectory made up of the stored waveform points $x_i$, the CPU 6 is arranged in step 510 to calculate the offset vector from the closest point on the stored trajectory thus selected in step 508 to the synthesised point $\underline{s}'_i$. The offset vector $\underline{b}_i$ thus calculated therefore comprises a three element vector.

Next, in step 512, the next offset vector $\underline{b}_{i+1}$ (in this case $\underline{b}_2$) is calculated by the CPU 6, by reading the matrix $T_i$ stored in relation to the preceding point $x_i$ (in this case in relation to point $x_{22}$) and multiplying this by the transpose of the first offset vector $\underline{b}_i$ (in this case $\underline{b}_1$).

Next, in step 514, the CPU 6 selects the next stored trajectory point $\underline{s}_i$+1, in this case, point $\underline{s}_{23}$ (defined by values $x_{23}$, $x_{13}$ and $x_{33}$).

In step 516, the next synthesised speech point is calculated ($\underline{s}'_{i+1}$) by adding the newly calculated offset vector $\underline{b}_{i+1}$ to the next point on the trajectory $\underline{s}_{i+1}$.

Then, the centre value $x'_{i+1}$ of the newly synthesised point $\underline{s}'_{i+1}$ is output to the DAC 4 and loudspeaker 2.

In step 520, the CPU 6 determines whether the required predetermined duration of the phoneme being synthesised has been reached. If not, then the CPU 6 returns to step 508 of the control program, and determines the new closest point on the trajectory to the most recently synthesized point. In many cases, this may be the same as the point $\underline{s}_{i+1}$ from which the synthesised point was itself calculated, but this is not necessarily so.

Thus, by following the process of steps 506–518, the CPU 6 is able to synthesis a speechlike waveform (shown as a dashed trajectory in state sequence space in FIGS. 9*a* and 9*b*) from the stored waveform values $x_i$ and transform matrices $T_i$.

The length of the synthesised sequence does not in any way depend upon the number of stored values, nor does the synthesised sequence exactly replicate any portion of the stored sequence.

Instead, each point on the synthesised sequence depends jointly upon the preceding point in the synthesised sequence; the nearest other points (in state sequence space) in the stored sequence; and the transform matrix in relation to the nearest point in the stored sequence.

Thus, due to the random selection of start points in step 506, the synthetic waveform generated will differ from one synthesis process to the next.

When the predetermined end point for the phoneme in question has been reached in step 520, in step 522 the CPU 6 determines whether the end of the desired sequence (e.g.

as shown in FIG. 8) has been reached, and if so, in a step 524 the CPU 6 causes the output sequence to progress to silence (as will be discussed in greater detail below).

If not, the CPU 6 selects the next sound in the sequence (step 525) and determines, in a step 526, whether the next sound is voiced or not. If the next sound is voiced, the CPU 6 returns to step 502 of FIG. 7, whereas if the next sound is unvoiced, in a step 528 the CPU 6 progresses (as will be described in greater detail below) to the selected unvoiced sound, which is then reproduced in step 530 (as will be described in greater detail below). The CPU 6 then returns to step 522 of FIG. 7.

Calculation of Transform Matrix

Figure 10:
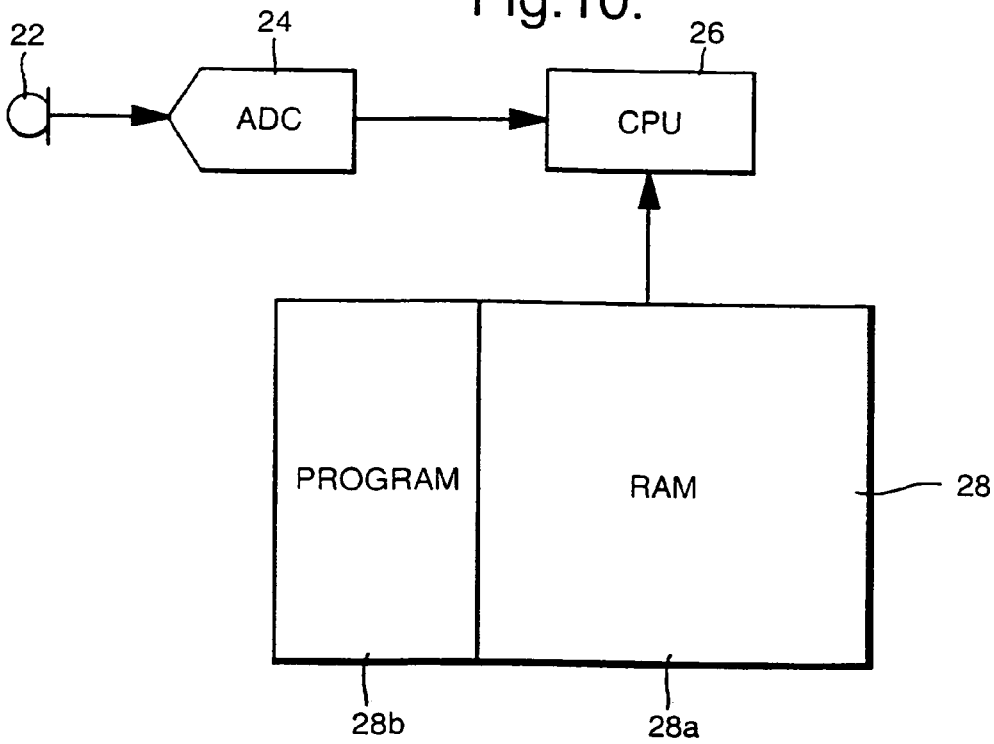
FIG. 10 is a block diagram showing schematically the components of apparatus for deriving the synthesised data used in the embodiment of FIG. 6.

Referring to FIG. 10, apparatus for deriving the stored sample and transform records 10 comprises a microphone 22, an analog to digital converter 24, a CPU 26, and a storage device 28 (provided, for example, by a mass storage device such as a disk drive and random access memory) comprising a working scratch pad memory 28*a* and a program memory 28*b*.

Naturally, the CPU 26 and storage device 28 could be physically comprised by those of a speech synthesizer as shown in FIG. 6, but it will be apparent that this need not be the case since the data characterising the speech synthesizer of FIG. 6 is derived prior to, and independently of, the synthesis process.

Conveniently, the analog to digital converter 24 is arranged to sample the analog speech waveform from the microphone 22 at a frequency of around 20 kHz and to an accuracy of 16 bits.

Figure 11A:
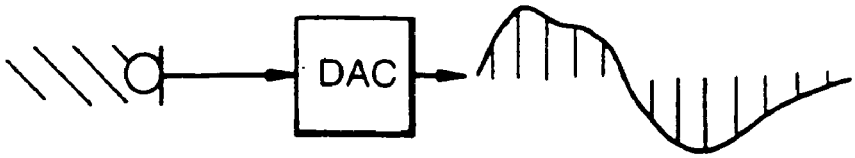
FIGS. 11*a–d* illustrates the data produced at various stages of the process of operation of the apparatus of FIG. 10.
Figure 11B:
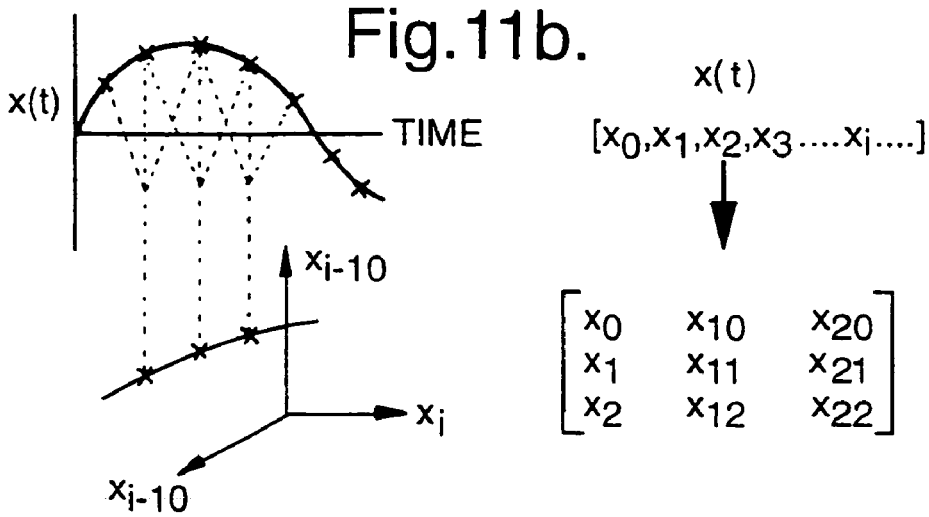
Figure 11C:
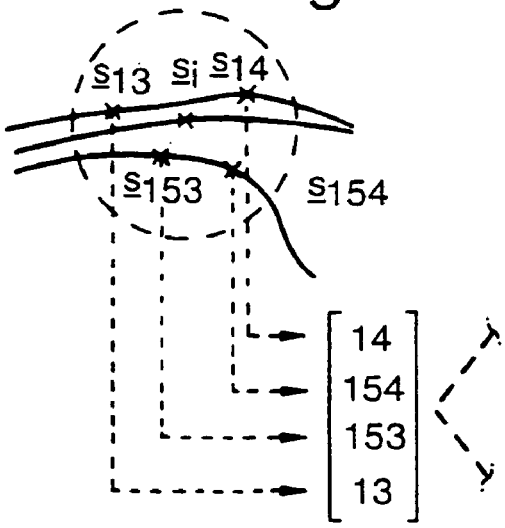
Figure 11D:
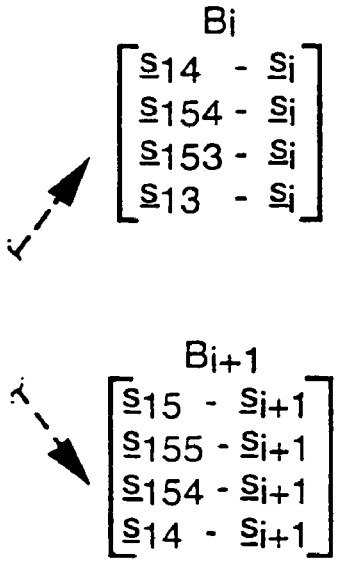
Figure 12:
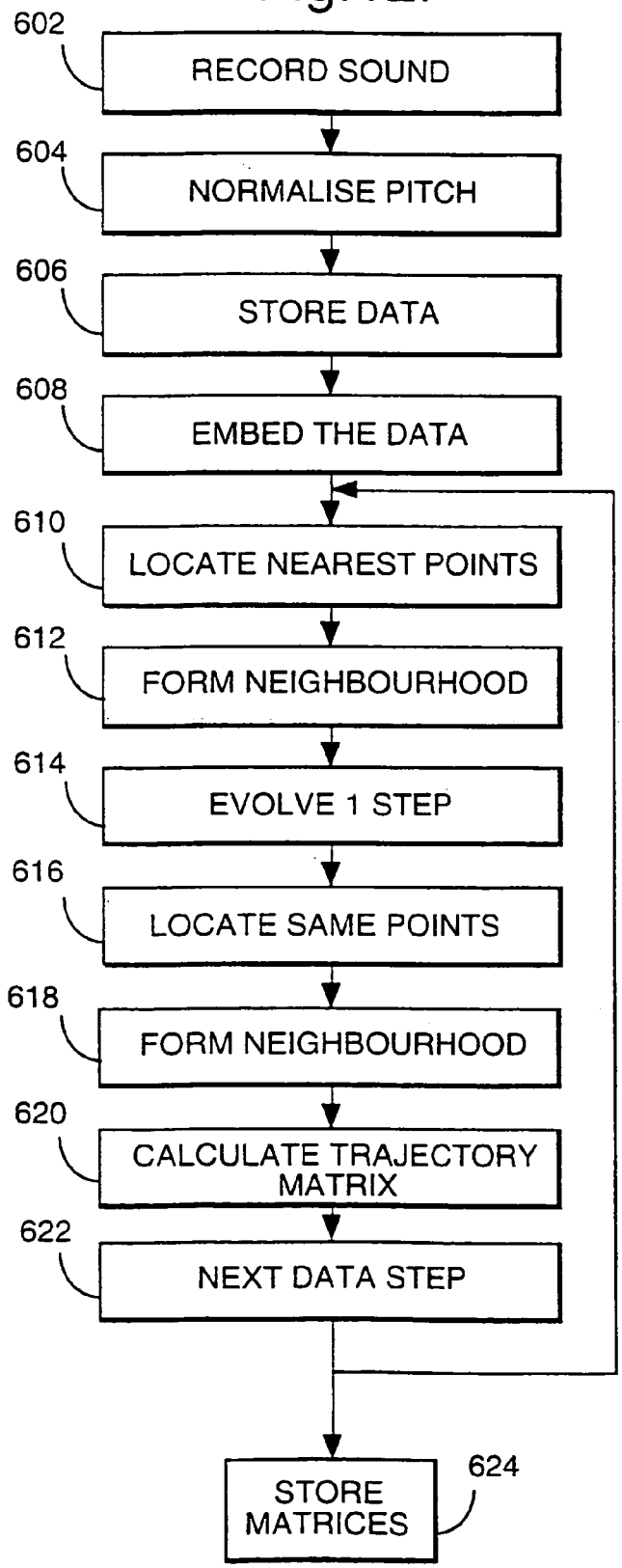
FIG. 12 is a flow diagram illustrating the stages of operation of the apparatus of FIG. 10.

Referring to FIGS. 11 and 12, the operation of the apparatus of FIG. 10 will now be described. In a step 602, as shown in FIG. 11*a*, whilst a human speaker recites a single utterance of a desired sound (e.g. a vowel) the CPU 26 and analog to digital converter 24 sample the analog waveform thus produced at the output of the microphone 22 and store successive samples (e.g. around 10,000 samples, corresponding to around half a second of speech) in the working memory area 28*a*.

Next, in a step 604, the CPU 26 is arranged to normalise the pitch of the recorded utterance by determining the start and end of each pitch pulse period (illustrated in FIG. 1) for example by determining the zero crossing points thereof, and then equalising the number of samples within each pitch period (for example to 140 samples in each pitch period) by interpolating between the originally stored samples.

As a result of such normalisation, the stored waveform therefore now consists of pitch pulses each of an equal number of samples. These are then stored (step 606) as the sample record 11 of the record 10 for the sound in question, to be used in subsequent synthesis.

Next, in a step 608, the linear array of samples $x_0$, $x_i$ . . . is transformed into an array of three dimensional coordinate points $\underline{s}_0$, $\underline{s}_1$ . . . , each coordinate point $\underline{s}_i$ corresponding to the three samples $x_{i-10}$, $x_i$, $x_{i+10}$, so as to embed (i.e. represent) the speech signal in a state sequence space, as illustrated in FIG. 11*b*.

The first coordinate point is then selected (i.e. $\underline{s}_{10}$).

The trajectory of points through the state sequence space is, as discussed above in relation to FIGS. 3 and 4, substantially repetitive. Thus, the trajectory consists, at any point, of a number of close "strands" or "tracks", each consisting of the equivalent portion of a different pitch pulse.

Referring to step 610, for the selected point $\underline{s}_i$ (in this case, the first point, $\underline{s}_{10}$), there will be other points on other tracks of the attractor, which are close in state sequence space to the selected point $\underline{s}_i$. For example, as shown in FIG. 11*c*, points $\underline{s}_{13}$ and $\underline{s}_{14}$ on a first track, and $\underline{s}_{153}$ and $\underline{s}_{154}$ on a second track, are close to the point $\underline{s}_{10}$. Accordingly, in a step 610, the CPU 26 locates all the points on other tracks (i.e. in other pitch periods) which are closer than a predetermined distance D in state sequence space (D being the euclidean, or root mean square, distance for ease of calculation). To avoid a search and distance comparison of all 10,000 stored points, the CPU 26 may examine only a limited range of points, e.g. those in the range of $\underline{s}_{[i+/-5+k,\ 140]}$, where k is an integer, and, in this example, there are 140 samples in a pitch period, so as to examine roughly corresponding areas of each pitch pulse to that in which the reference point $\underline{s}_i$ is located.

Figure 13:
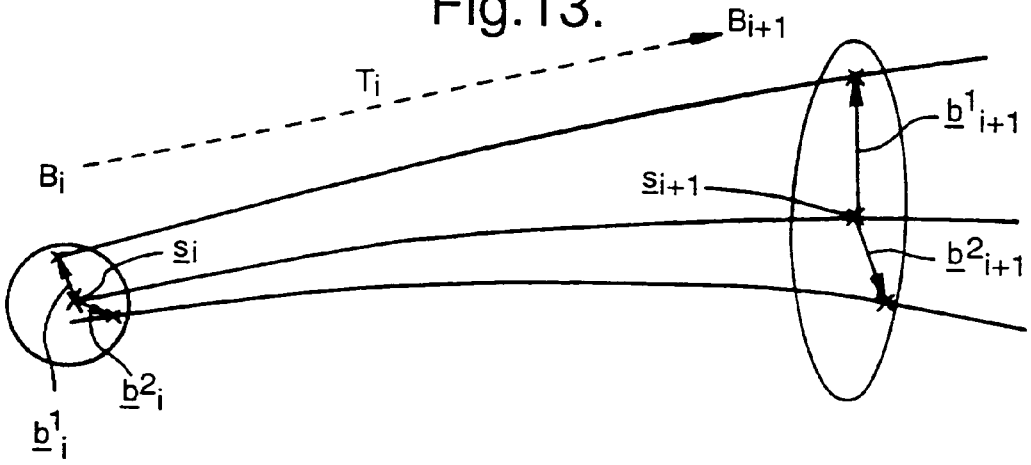
FIG. 13 is a state sequence space diagram showing illustratively the effect of the transformation over time of the neighbourhood of FIG. 9*c;*

Having located a group of points on other tracks than that of the reference point $\underline{s}_i$, the CPU 26 then stores a neighbourhood array $B_i$ of vectors $\underline{b}_i$, as shown in FIG. 11*d*, in step 612. Each of the vectors $\underline{b}_i$ of the array $B_i$ is the vector from the reference point $\underline{s}_i$ to one of the other neighbouring points on a different track of the attractor, as shown in FIGS. 11 and 13. A set of such vectors, represented by the neighbourhood matrix $B_i$, provides some representation of the local shape of the attractor surrounding the reference point $\underline{s}_i$, which can be used to determine how the shape of the attractor changes as will be described further.

Next, in step 614, the CPU 26 selects the next point $\underline{s}_{i+1}$ along the same track as the original reference point $\underline{s}_i$.

Next, in step 616, the CPU 26 progresses forward one point on each of the other tracks of the attractor, so as to locate the corresponding points on those other tracks forming the new neighbourhood to the new reference point $\underline{s}_{i+1}$, in step 616. In step 618, the CPU 26 calculates the corresponding neighbourhood array of vectors $B_{i+1}$.

Because the pitch pulses of the recorded utterance differ slightly one from another, the corresponding tracks of the attractor trajectory marked out by the recorded samples will also differ slightly one from another. At some points, the tracks will be closer together and at some points they will be more divergent.

Thus, the new set $B_{i+1}$ of offset vectors $\underline{b}_{i+1}$ will have changed position, will have rotated somewhat (as the attractors form a loop), and will also in general be of different lengths to the previous $B_i$ set of vectors $\underline{b}_i$. Thus, in progressing around the attractor track from one sample to the next, the set $B_i$ of vectors $b^1_i$, $b^2_i$ (and hence the shape of the attractor itself which they represent are successively transformed by displacement, rotation and scaling.

Next, in step 620, the transformation matrix $T_i$ which transforms the set of vectors $B_i$ defining the attractor in the neighbourhood of point $\underline{s}_i$ to the set of vectors $B_{i+1}$ defining the neighbourhood of the attractor in the region of the reference point $\underline{s}_{i+1}$ is calculated in step 620. The matrix is therefore defined as:

$$B^T_{i+1}=T_i B_i^T$$

This can be rearranged to the following form:

$$T_i^T B_i^{-1} B_{i+1}$$

In general, since $B_i$ is a d×3 matrix (where d is the number of displacement vectors used, which may be greater than 3) $B_i$ will not have an exact inverse $B_i^{-1}$, but the pseudo inverse can instead be calculated, as described in Moore and Penrose, "A generalised inverse for matrices", Proc. Camb. Phil. Soc., Vol. 51, pages 406–413, 1955.

The 3×3 transform matrix $T_i$ thus calculated is an approximation to the transformation of any one of the vectors making up the neighbourhood matrix $B_i$. However, since the neighbourhood in the state sequence space is small, and since speech is locally linear over small intervals of time, the approximation is reasonable.

Next, in step 622, the CPU 26 selects the next point $\underline{s}_{i+1}$ as the new reference point and returns to step 610.

Thus, after the process of steps 610 to 622 has been performed for each of the points $\underline{s}_i$ corresponding to digitised speech sample values $x_i$, all the transform matrices thus calculated are stored (step 624) associated with the respective data values $x_i$ corresponding to the reference points $\underline{s}_i$ for which the matrix was derived, in a data record 12.

Thus, at the end of the process of FIG. 12, the stored transform matrices Ti each represent what happens to a displacement vector $\underline{b}_i$, from the point on an attractor for which the transform matrix was calculated to another point in space close by, in moving one sample forward in time along the attractor. It will therefore be understood how the use in FIG. 7 of the transform matrices thus calculated enables the construction of a new synthesised point on the attractor, using a stored actual trajectory forming part of the attractor, a previous synthesised point (and hence a previous vector from the stored trajectory to that previous synthesised point) and the transformation matrix itself.

The above description relates to the derivation of stored data for synthesis of a voiced sound. For storage of data relating to unvoiced sounds, only steps 602 and 606 are performed, since the storage of the transform matrix is not required.

Having derived the necessary data for each voiced or unvoiced sound in the phonetic alphabet as described above, the stored data are transferred (either by communications link or a removable carrier such as a floppy disk) to the memory 8 of synthesis apparatus of FIG. 6.

Reproduction of Unvoiced Sounds

Mention is made in step 530 of reproduction of unvoiced sounds. As discussed above, unvoiced sounds do not exhibit stable low dimensional behaviour, and hence they do not follow regular, repeating attractors in state sequence space and synthesis of an attractor as described above is therefore unstable. Accordingly, unvoiced sounds are produced in this embodiment by simply outputting, in succession, the stored waveform values $x_i$ stored for the unvoiced sound to the DAC 4. The same is true of plosive sounds.

Progression to Sounds

In relation to steps 504, 524 and 528 of FIG. 7, mention was made of progression to or between sounds. One possible manner of progression, usable with the above described embodiment, will now be disclosed in greater detail.

Figure 14:
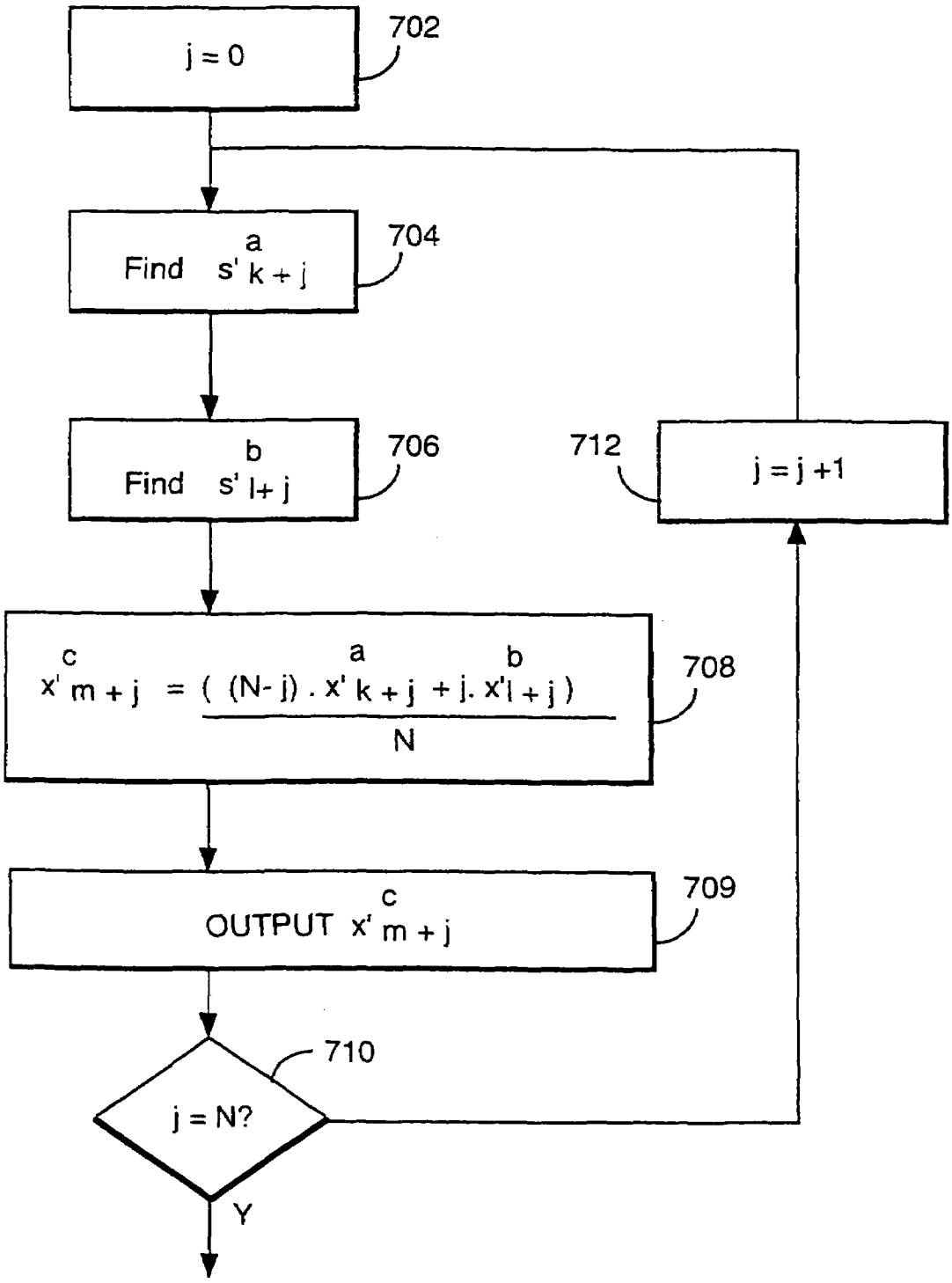
FIG. 14 is a flow diagram showing in greater detail the process of progressing from one sound to another forming part of the flow diagram of FIG. 7.
Figure 15:
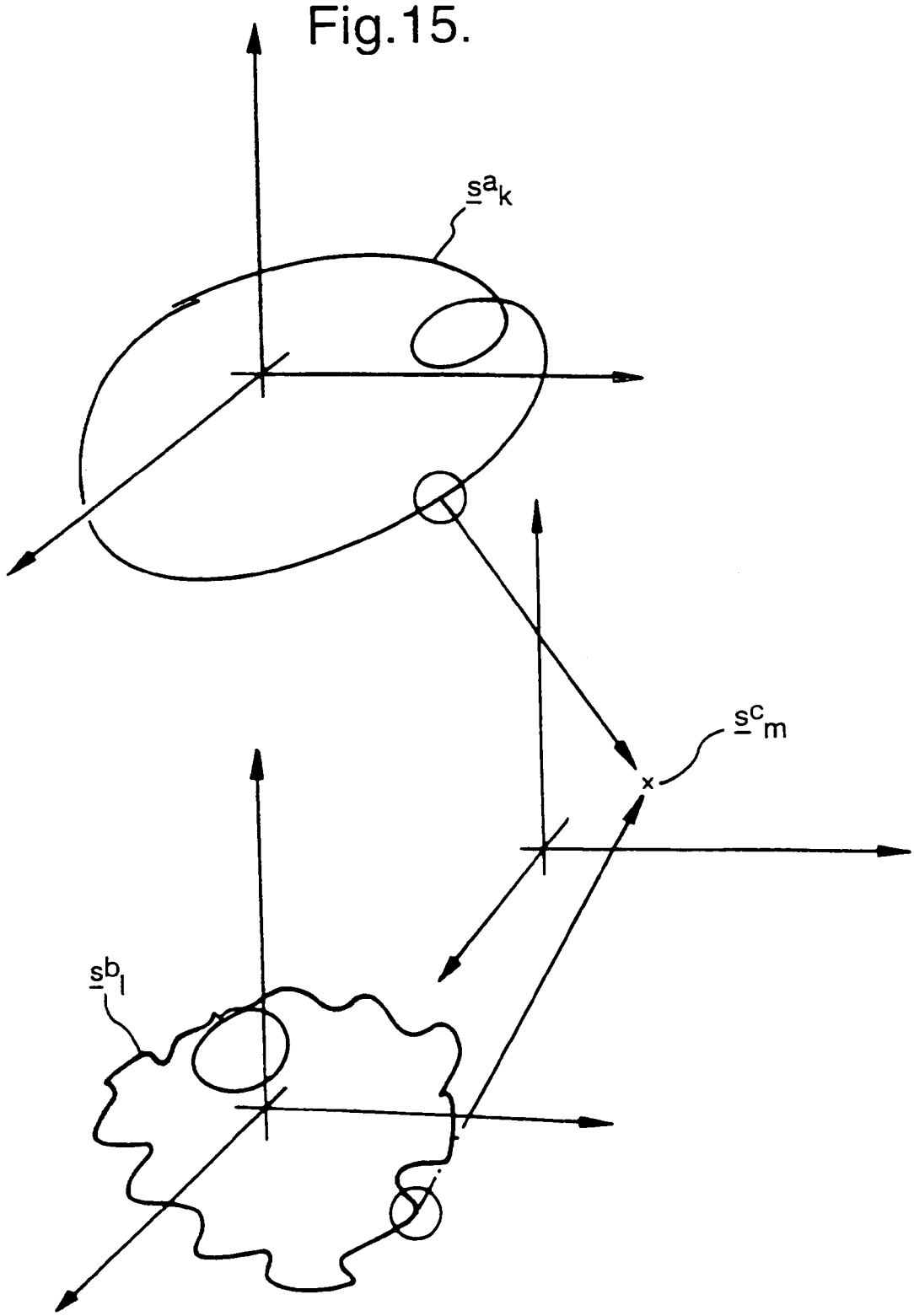
FIG. 15 is an illustrative diagram indicating the combination of two state space sequences performed during the process of FIG. 14.

Referring to FIGS. 14 and 15, FIG. 14 illustrates the steps making up step 504 or step 528 of FIG. 7, whereas FIG. 15 graphically illustrates the effect thereof.

Broadly speaking, the present invention interpolates between two waveforms, one representing each sound, in state sequence space. The state space representation is useful where one or both of the waveforms between which interpolation is performed are being synthesised (i.e. one or both are voiced waveforms). Broadly speaking, in this embodiment, the synthesised points in state space are derived, and then the interpolated point is calculated between them; in fact, as discussed below, it is only necessary to interpolate on one co-ordinate axis, so that the state space representation plays no part in the actual interpolation process.

The interpolation is performed over more than one pitch pulse cycle (for example 10 cycles) by progressively linearly varying the euclidean distance between the two waveforms in state sequence space.

Thus, as indicated in FIG. 15, the coordinates of a given point $\underline{s}^c_m$ during transition between voiced sounds are derived from the coordinates in state sequence space of a synthesis point on the attractor of the first sound $\underline{s}^a_k$ and a corresponding point on the attractor of the second sound $\underline{s}^b_l$.

In more detail, referring to FIG. 14, in a step 702, an index j is initialised (e.g. at zero).

In step 704, the current value of the synthesised attractor on the first waveform $\underline{s}'^a_k$ is calculated, as disclosed above in relation to FIG. 7.

In a step 706, the CPU 6 scans the recorded sample values for the second sound to be progressed towards and locates (for example by determining the zero crossing points) the sample $\underline{s}_l^b$ at the same relative position within a pitch period of the second waveform as the point $\underline{s}_k^a$. In other words, if the point $\underline{s}_k^a$ on the first waveform is the 30th point within a pitch period of the first sound from the zero crossing thereof, the point $\underline{s}_l^b$ is also selected at the 30th point after the zero crossing of a pitch period of the second sound.

Then, a synthesised attractor point $\underline{s}'^b_l$ is calculated as disclosed above in relation to FIG. 7.

Next, in a step 708, the coordinates of an interpolated point $\underline{s}_m^c$ are calculated by linear interpolation, in step 708. It is only necessary to calculate one dimension of the interpolated attractor, since it is only the current output sample value which is desired to be synthesised, not the sample value ten samples previously or ten samples in the future. Thus, in step 708, the interpolation calculation actually performed is:

$$x'^{ic}_{m+j}=((N-j).x'^a_{k+j}+j.x'^b_{l+j})/N$$

Where N is the number of samples over which interpolation is performed, and j is an index running from 0 to N, and k,l and m label the sample values (used in the interpolation) of the attractor of the first sound, the attractor of the second sound and the intermediate state space sequence respectively.

Then, in step 709, the CPU outputs $x'^c_i$, the current sample value thus calculated, to the DAC for and hence loudspeaker 2 for synthesis.

In step 710, the CPU 6 tests whether the end of a predetermined transition duration has been reached (e.g. of 400 samples, so that N=400) and, if not, in step 712 the index j is incremented, and in steps 704, 706, and 708 are repeated to calculate the next values of the synthesised attractor ($\underline{s}'^a_{k+j}$) and the attractor of the new sound $\underline{s}'^b_{l+j}$ and derive the next sample value for output.

When the last sample of the transition, j=N, has been reached in step 710, the CPU 6 proceeds with step 506 or step 530, as discussed above in relation to FIG. 7, to synthesise the new sound corresponding to the attractor of the second sound.

The above described process applies equally where a transition is occurring from silence to a stored representative sound. In this case, rather than calculating a value for $\underline{s}'^a_i$, the CPU 6 reads a corresponding value of zero, so that the corresponding effect is simply a linear fade to the required synthesised sound.

Likewise, when the transition is from a sound to silence, as in step 524, the same sequence as described above in relation to FIG. 14 is performed except that instead of calculating successive synthesised values of the attractor of the second sound, the CPU 6 is arranged to substitute zero values, so as to perform a linear fade to silence.

Progression to and From Unvoiced Sounds

The process of progression described above in relation to FIG. 14 is modified in relation to progression to or from an unvoiced sound, because rather than synthesising the unvoiced sound, the actual stored value of the unvoiced sound is reproduced. Accordingly, in progression from one unvoiced sound to another, state sequence space plays no part since it is merely necessary to interpolate between corresponding successive pairs of points in the old unvoiced sound and the new unvoiced sound. Likewise, in progressions between an unvoiced sound and silence, a linear fade to or from the value of successive points of the unvoiced sound is performed.

SECOND EMBODIMENT

Rather than storing the transformation matrix for each point, in the second embodiment the transformation matrix is calculated directly at each newly synthesised point; in this case, the synthesizer of FIG. 6 incorporates the functionality of the apparatus of FIG. 10. Such calculation reduces the required storage space by around one order of magnitude, although higher processing speed is required.

In this embodiment, rather than interpolating between sample values directly to produce output sample values as described above in the first embodiment, it is possible to interpolate to produce intermediate attractor sequences and corresponding transformation matrices describing the dynamics of the intermediate transformation sequences. This gives greater flexibility, in that it is possible to stretch the production of the intermediate sounds over as long a period as is required.

Figure 16:
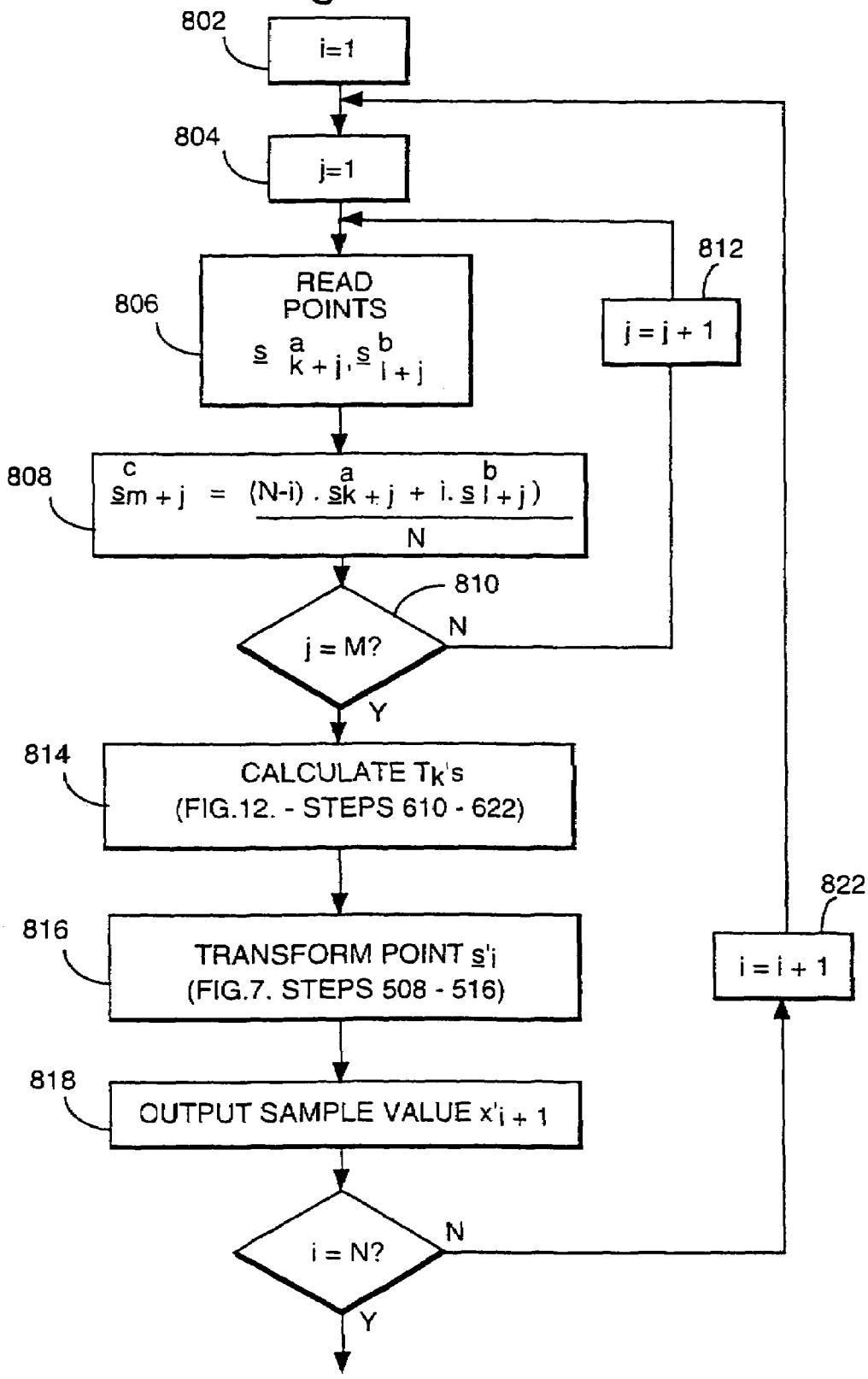
FIG. 16 is a flow diagram showing the process of progressing from one sound to another in a second embodiment of the invention.

Referring to FIG. 16, in this embodiment, in a step 802, a first counter i is initialised. The counter i sets the number of intermediate templates which are produced, and is conveniently of a length corresponding to several pitch cycles (in other words, N, the maximum value for i, is around 300–400).

In a step 804, the value of another counter j is initialised; this corresponds to the number of stored points on each of the two stored waveforms (and its maximum, M, is thus typically around 10,000).

In a step 806, a corresponding pair of points $\underline{s}^a_k$, $\underline{s}^b_l$ are read from the stored waveform records 10; as described in the first embodiment, the points correspond to matching parts of the respective pitch pulse cycles of the two waveforms.

Next, in a step 808, an interpolated point $\underline{s}^c_m$ is calculated as described in the first embodiment.

If the last point on the waveforms has not been reached (step 810), in step 812 the value of the counter along the waveforms, j, is incremented and steps 806–810 are repeated.

Thus, following execution of steps 804–812 for each stored point, around half a second of an intermediate waveform which defines a repetitive trajectory in space will have been calculated.

Then, in step 814, the CPU 6 performs the steps 610–622 of FIG. 12, to calculate the transform matrices $T_k$ for each point along this stored track.

After performance of step 814, sufficient information (in the form of a stored interpolated trajectory and stored interpolated transformation matrices) is available to synthesise a waveform of any required length from this intermediate trajectory. In fact, however, this calculated data is used to derive only a single new point in state sequence space, $\underline{s}'_{i+1}$, by transforming the previous value of $\underline{s}'_i$ which was most recently output, in step 816.

The sample value $x'_{i-1}$ thus calculated as part of $\underline{s}'_{i+1}$ in output in step 818, and, until the end of the transition portion has been reached (step 820), the interpolation index i is incremented (step 822) and the CPU 6 returns to step 804 to calculate the next interpolated trajectory and set of dynamics $T_k$, and hence the next point to be output.

It will be apparent that, although in the above described embodiment, each interpolated trajectory and set of transformation vectors is used only once to calculate only a single output value, in fact fewer interpolated sets of trajectories and sets of transformation matrices could be calculated, and the same trajectory used for several successive output samples.

Equally, although linear interpolation has been discussed above, it would be possible to use a non-linear interpolation (describing, for example a sigmoid function).

Equally, whilst the process of FIG. 16 has been described for producing a progression between two sounds by interpolation, it would be possible to use the process of steps 804–818 to produce a constant intermediate sound between two stored sounds, thus enabling the production of intermediate vowels or other sounds from a more limited subset of stored sounds.

OTHER EMBODIMENTS AND VARIATIONS

It will be apparent from the foregoing description that many modifications or variations may be made to the above described embodiment without departing from the invention.

Firstly, although the foregoing describes storage of multiple pitch pulse sequences, it would be possible to store only a single pitch pulse sequence (i.e. a single track of the attractor) for each voiced sound, since the synthesis process will enable the reproduction of multiple different synthesised pitch pulse sequences therefrom. This may reduce the volume of data necessary for storage under some circumstances.

Indeed, rather than storing an actual attractor track, it will be clear that some other reference curve (for example an averaged attractor track) could be stored, provided that the transformation matrices from such other curve to the actual attractor strands had previously been calculated as described above.

Although in the above described embodiment, the dynamics of the speech waveform (in the state sequence space) are described by a neighbourhood matrix describing the transformation of vectors running between adjacent strands of an attractor, it will be clear that the transformation matrix could instead describe the evolution of a point on the attractor directly.

However, we have found that describing the transformation of a difference vector between an actual attractor and another actual or synthesised attractor has the virtue of greater stability, since the synthesised waveform will always be kept reasonably chose to an actual stored attractor.

Rather than progressing between respective synthesised values of voiced sounds, it is possible to progress between respective stored values, in the same manner as described above in relation to progress between unvoiced sounds; in this case, the progression is therefore simply performed by linear interpolation between successive pairs of corresponding stored sample points of the two sounds, although an improvement in performance is obtained if the interpolation is between points from corresponding portions of pitch pulses as described above.

To determine corresponding points in successive pitch pulses, rather than utilising zero crossings as discussed above, it would be possible to record the physical motion of the human vocal system using a laryngograph monitoring the human speaker recording the utterances as described in relation to FIG. 12, to directly identify corresponding physical positions of the human vocal system. Equally, the positions in state sequence space of the respective attractors of the two sounds could be used to identify respective portions of the sounds (although this method can lead to ambiguities).

The speech synthesizer of the embodiment of FIG. 6 is described as generating samples one by one at the time each sample is calculated, but it would of course be possible to generate and buffer a sequence of samples prior to reproduction.

It would be straightforward to modify the synthesizer disclosed above in relation to FIG. 6 to provide that the CPU effects amplitude control by scaling the value of each output sample calculated, or by direct control of an analog amplifier connected to the loudspeaker 2.

In this case progressions to and from silence may additionally or alternatively utilise a progessive amplitude increase or reduction.

Equally, it would be straightforward to provide for variation of pitch in the described embodiment, by altering the rate at which the CPU 6 supplies output samples to the digital to analog converter 4.

Although in the above described embodiment a digital to analog converter and a loudspeaker are provided, it is of course possible for the digital to analog converter and loudspeaker to be located remotely. For example, the speech synthesizer may in another embodiment be provided at a site within a telecommunications network (for example at a network control station or within an exchange). In such a case, although the speech synthesizer could provide an analog output, it may equally be convenient for the speech synthesizer to supply a train of digital sample outputs since the speech carried by the telephone network may be in digital form; eventual reconstruction to an analog waveform is therefore performed in this embodiment by local exchange or end user terminal components rather than a digital to analog converter and loudspeaker forming part of the speech synthesizer. For example, such an embodiment may be applied in relation to automated directory enquiries, in which stored subscriber telephone number digital information is reproduced as a speech signal under the control of a human operator or a speech recogniser device.

It will be apparent that many other modification and variants may be formed without departing from the essence of the present invention.

The invention claimed is:

1. A method of generating a cyclical sound waveform corresponding to a sequence of substantially similar cycles, said method comprising:

(a) generating a cyclical sound waveform sample;

(b) generating a successive cyclical sound waveform sample from said cyclical sound waveform sample and transformation data, wherein said transformation data comprise data defining the evolution of said cycles in a temporal vicinity of said cyclical sound waveform and the change in shape of said cycles in said temporal vicinity from cycle to cycle;

(c) designating said successive cyclical sound waveform sample as a cyclical sound waveform sample and repeating (b);

(d) repeating (c) a plurality of times to generate a sequence of said successive cyclical sound waveform samples corresponding to a plurality of said cycles; and (e) outputting the samples of said sequence to generate a waveform representing a cyclical sound.

2. A method according to claim 1, in which said waveform comprises voiced speech.

3. A method according to claim 1 in which said transformation data does so by reference to a predetermined reference waveform sequence.

4. A method according to claim 3, in which said reference waveform sequence comprises a stored speech waveform.

5. A method according to claim 3, in which a given successive waveform sample is derived in accordance with data from a point on said reference waveform sequence at a position within a said cycle which corresponds to that of said given successive waveform sample, and at least one other point on said reference waveform sequence offset in time therefrom.

6. A method according to claim 1, in which said steps (a) and (b) comprise generating a plurality of values representing said waveform sample values as a point in a multidimensional space in which corresponding portions of successive said cycles are substantially superposed.

7. A method according to claim 6 in which said transformation data does so by reference to a predetermined reference waveform sequence and in which said transformation data represents a transformation which approximates a transformation which would transform a first displacement vector, extending from a first time point on said reference waveform sequence to a corresponding time point on the waveform to be synthesised, to a second displacement vector extending from a second point, successive to the first, on said reference waveform sequence to a corresponding second point on the waveform to be synthesised.

8. A method according to claim 1, in which said step (b) comprises calculating said transformation data from a set of stored waveform values.

9. A method according to claim 1, in which the initial performance of said step (a) to initial synthesis of said waveform comprises a step of selection of an initial value which differs from a previous initial value selected on a previous synthesis of said waveform.

10. A method according to claim 9 in which said selection step comprises applying a pseudo random number generation algorithm to select said value.

11. A method according to claim 9 in which said step of selection comprises referring to a stored waveform sample value and calculating a synthesised initial waveform value similar but different to said stored waveform value.

12. A method of generating a synthetic voiced speech waveform, said method comprising:

(a) storing data defining n-dimensional state space representations of voiced speech signals, n being an integer having a value of at least three, in which successive voiced speech pitch pulse cycles are superimposed to provide a model of voiced speech dynamics;

(b) selecting a synthesized waveform starting point in said n-dimensional state space representation for a predetermined voiced speech waveform that is offset from said stored data by an offset vector;

(c) selecting successive further synthesized waveform points in said n-dimensional state space representation for said predetermined voiced speech waveform that are also respectively offset from said stored data in dependence jointly upon the preceding point in the synthesized sequence, nearest other stored points in state sequence space and an offset vector therefrom;

(d) repeating (b) and (c) for plural voiced speech pitch cycles; and (e) outputting the resulting sequence of thus synthesized waveform points to generate a voiced speech waveform.

13. A method of generating a synthetic voiced speech waveform, said method comprising:

(a) storing data defining n-dimensional state space representations of plural voiced speech waveform portions, n being an integer having a value of at least three, in which successive voiced speech pitch pulse cycles are superimposed in n-dimensional state space to provide a model of voiced speech dynamics;

(b) generating synthesized waveform points using said n-dimensional state space representation for a predetermined voiced speech waveform portion, (c) repeating (b) for plural successive different predetermined voiced speech waveform portions; and (d) outputting the resulting sequence of thus synthesized waveform points to generate a voiced speech waveform.

14. Synthesis apparatus comprising:

(a) means for generating a cyclical sound waveform sample;

(b) means for generating a successive cyclical sound waveform sample from said cyclical sound waveform sample and transformation data, wherein said transformation data comprise data defining the evolution of said cycles in a temporal vicinity of said cyclical sound waveform and the change in shape of said cycles in said temporal vicinity from cycle to cycle;

(c) means for designating said successive cyclical sound waveform sample as a cyclical sound waveform sample and repeating (b);

(d) means for repeating (c) a plurality of times to generate a sequence of said successive cyclical sound waveform samples corresponding to a plurality of said cycles; and (e) means for outputting the samples of said sequence to generate a waveform representing a cyclical sound.

15. A method of generating a cyclical sound waveform corresponding to a sequence of substantially similar cycles, said method comprising:

(a) generating a first instantaneous value of the amplitude of a cyclical sound waveform;

(b) generating a second instantaneous value of the amplitude of a cyclical sound waveform from said first instantaneous value and transformation data, wherein said transformation data comprise data defining the evolution of said cycles in the temporal vicinity of said cyclical sound waveform and the change in shape of said cycles in said temporal vicinity from cycle to cycle;

(c) designating said second instantaneous value as a first instantaneous value and repeating (b);

(d) repeating (c) a plurality of times to generate a sequence of said instantaneous values corresponding to a plurality of said cycles; and (e) outputting the instantaneous values of said sequence to generate a waveform representing a cyclical sound.

16. Synthesis apparatus comprising:

(a) means for generating a first instantaneous value of the amplitude of a cyclical sound waveform;

(b) generating a second instantaneous value of the amplitude of a cyclical sound waveform from said first instantaneous value and transformation data, wherein said transformation data comprise data defining the evolution of said cycles in the temporal vicinity of said cyclical sound waveform and the change in shape of said cycles in said temporal vicinity from cycle to cycle;

(c) designating said second instantaneous value as a first instantaneous value and repeating (b);

(d) means for repeating (c) a plurality of times to generate a sequence of said instantaneous values corresponding to a plurality of said cycles; and (e) outputting the instantaneous values of said sequence to generate a waveform representing a cyclical sound.

* * * * *